US006730638B2

(12) United States Patent
Farng et al.

(10) Patent No.: US 6,730,638 B2
(45) Date of Patent: May 4, 2004

(54) LOW ASH, LOW PHOSPHORUS AND LOW SULFUR ENGINE OILS FOR INTERNAL COMBUSTION ENGINES

(75) Inventors: Liehpao O. Farng, Lawrenceville, NJ (US); Andrew Jackson, Pennington, NJ (US); Willie A. Givens, Jr., Glassboro, NJ (US); Douglas E. Deckman, Mullica Hill, NJ (US); William H. Buck, West Chester, PA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 10/350,561

(22) Filed: Jan. 24, 2003

(65) Prior Publication Data

US 2003/0158048 A1 Aug. 21, 2003

Related U.S. Application Data

(60) Provisional application No. 60/353,757, filed on Jan. 31, 2002.

(51) Int. Cl.[7] ..... C10M 141/12

(52) U.S. Cl. ..... 508/194; 508/364; 508/371; 508/372; 508/379; 508/391; 508/460; 508/586

(58) Field of Search ..... 508/194, 364, 508/371, 372, 379, 391, 460, 586

(56) References Cited

U.S. PATENT DOCUMENTS

| | | | | | |
|---|---|---|---|---|---|
| 4,904,401 | A | | 2/1990 | Ripple et al. | 252/32.7 |
| 5,110,488 | A | * | 5/1992 | Tipton et al. | 508/192 |
| 5,696,065 | A | | 12/1997 | Tanaka et al. | 508/465 |
| 6,010,987 | A | | 1/2000 | Stiefel et al. | 508/363 |
| 6,074,993 | A | | 6/2000 | Waddoups et al. | 508/364 |
| 6,143,701 | A | | 11/2000 | Boffa | 508/363 |
| 6,300,291 | B1 | | 10/2001 | Hartley et al. | 508/363 |
| 6,444,624 | B1 | | 9/2002 | Walker et al. | 508/363 |
| 6,500,786 | B1 | | 12/2002 | Hartley et al. | 508/365 |
| 2003/0148895 | A1 | * | 8/2003 | Robson et al. | 508/155 |
| 2003/0182847 | A1 | * | 10/2003 | Katafuchi | 44/358 |

* cited by examiner

*Primary Examiner*—Jacqueline V. Howard
(74) *Attorney, Agent, or Firm*—Norby L. Foss

(57) ABSTRACT

A lubricating composition for internal combustion engines especially useful with fuels having less than 350 ppm sulfur comprises a lubricating oil basestock, a boron containing ashless dispersant, a molybdenum containing friction reducing agent, a metal type detergent and zinc dithiophosphate.

14 Claims, No Drawings

LOW ASH, LOW PHOSPHORUS AND LOW SULFUR ENGINE OILS FOR INTERNAL COMBUSTION ENGINES

This application claims the benefit of U.S. Provisional Application(s) No(s).: 60/353,757 filed on Jan. 31, 2002.

FIELD OF INVENTION

This invention relates to lubricating oil compositions having significantly low levels of sulfur, phosphorous and ash and which are especially suitable for use in conjunction with fuels having ultra-low sulfur content.

BACKGROUND OF INVENTION

Internal combustion engines, such as automobile spark ignition engines, require the use of a lubricant to protect engine parts from wear, to promote friction reduction, to suppress deposits formation and to improve engine cleanliness. Mineral or synthetic lubricating oils by themselves will not provide these properties at levels now required by users. Therefore, contemporary engine oil technology uses various additives in conjunction with base lubricating oils to enhance the properties of the base oil in at least one and typically in a number of different aspects.

Among the engine oil additives contained in most commercially available internal combustion engine oils are zinc dithiophosphates and metallic detergents. The former are included for their antiwear properties and oxidation inhibiting characteristics. The latter are included for their detergent properties. These additives are rich in sulfur, phosphorous and ash content and their presence presents problems in meeting ever more severe engine performance requirements. For example, sulfur compounds in engine exhaust gases are known to poison catalysts used in exhaust systems to reduce $NO_x$ emissions; and phosphorous is known to poison the hydrocarbon conversion catalysts used in those systems. In addition there is a need to lower ash levels to reduce plugging of particulate trap after-treatment devises.

Simply lowering the amount of zinc dithiophosphate and metallic detergents is not a practical solution to the problem because of the concomitant lowering of the antiwear properties and oxidation inhibition properties as well as the decreased detergency of the oil.

An object of the present invention is to provide a low sulfur, detergents is not a practical solution to the problem because of the concomitant lowering of the antiwear properties and oxidation inhibition properties as well as the decreased detergency of the oil.

Another object is to provide an engine oil for use in conjunction with low sulfur fuels (<350 ppm) for enhanced automotive emission control.

SUMMARY OF INVENTION

The present invention provides a low sulfur, low phosphorous, low ash lubricating oil composition for internal combustion engines which is especially useful in conjunction with fuels having a sulfur content of less than 350 ppm by weight. The lubricating oil composition of the present invention comprises:

(a) a major amount of a base oil of lubricating viscosity and having a sulfur content below about 300 ppm based on the weight of base oil;

(b) about 0.5 wt % to about 10 wt % of a boron-containing ashless dispersant;

(c) about 0.05 wt % to about 1.50 wt % of a molybdenum containing friction reducing additive;

(d) about 0.05 wt % to about 5.0 wt % of at least one kind of metal-type detergent selected from the group consisting of sulfonates, phenates and salicylates; and (e) 0.10 wt % to 0.75 wt % of a zinc dithiophosphate.

The lubricating compositions of the present invention have a total base number less than 4, and preferably between about 3.25 to about 3.75, a phosphorous content less than 0.048 wt %, sulfated ash of less than 0.5 wt % and total sulfur content less than 0.18 wt %.

The lubricating composition of the present invention is particularly suitable for reducing friction and wear in engines combusting an ultra low sulfur fuel compared with lubricants containing greater amounts of sulfur, phosphorus and ash. Thus another embodiment of the invention is a method of reducing friction and wear in such engines by lubricating them with the composition broadly defined above.

DETAILED DESCRIPTION OF INVENTION

The base oil used in the composition of the present invention will contain less than 300 ppm sulfur and may be a mineral or synthetic oil or blends thereof. Suitable base oils include Group II, III, IV and V basestocks as defined by the API. Preferably the base oil is a Group IV or V basestock. Typically, the base oil will have a viscosity range of from about 15 to about 8000 cSt at 40° C. An especially preferred base oil is a blend of synthetic base oils such as polyalpha olefins (PAO's), poly internal olefins (PIO's), polyesters, alkylated aromatics, polybutenes, hydroprocessed oils and gas to liquid oils (GTL's) such as liquid base stock derived from hydroisomerized Fischer-Tropsch waxes having a viscosity in the range of 3 to 26.1 cSt at 100° C.

In the lubricating oil composition of the present invention a boron-containing ashless dispersant and/or metallic detergent is employed. Examples of suitable boron-containing ashless dispersants are compounds prepared by boration of succinimide, succinic ester, benzyl amine and fatty acid amides. The particularly preferred boron-containing ashless dispersant is a succinimide or succinic ester/amide derivative containing 0.1 to 5.0 wt % boron such as boronated mono and bis PIBSA/PAM. Typically the Mn of the PIB moiety in the preferred dispersant will be in the range of about 300 to about 4000. The boron-containing ashless dispersant is incorporated in the composition in an amount of about 0.5 to about 10 wt % based on the total weight of the composition. Boron free ashless dispersants optionally may be combined with the boron-containing dispersants.

Descriptions of dispersants can be found in the following U.S. Pat. Nos. 5,356,552; 4,904,401; 4,941,984; 4,904,401; 5,169,564; 5,133,900; 6,010,986; 6,159,912; and the following EP documents: 0 721 978 A2; 0 699 738B1; 0 389 573B1.

Regarding the molybdenum-containing additive used, mentioned is made of molybdenum diorganic dithiocarbamates molybdenum diorgano dithio phosphate, and moly carboxylates. Particularly preferred are trinuclear molybdenum compounds having the formula $Mo_3S_7(dtc)_4$, $Mo_3S_4(dtc)_4$ and mixtures thereof where dtc represents diorganodithiocarbamate ligands. Such compounds are disclosed in U.S. Pat. No. 6,010,987 (see also U.S. Pat. Nos. 5,696,065; 5,627,146; 5,631,213; 3,509,051. The amount of molybdenum containing additive will be in the range of about 0.05 to about 1.50 wt % based on the total weight of the composition.

Examples of metal-type detergents are the alkaline metal salts of sulfonates, phenates and salicylates. Generally the alkali metal used are calcium, magnesium and barium. These detergents may be employed singly or in combination. The amount of metal-type detergent used is in the range of about 0.1 to about 5.0 wt % based on the total weight of the composition. Optionally these metal detergents may be combined with boron containing metal detergents. Examples of suitable boron-containing metallic detergents are compounds prepared by boration of calcium, magnesium or other metallic phenates, sulfonates, phenates, salicylates, carboxylates containing 0.1 to 5.0 wt % boron. The boron containing metallic detergent may be incorporated in the composition in an amount of about 0.1 to about 5 wt % based on the total weight of the composition.

As the zinc dialkyldihiophosphate (ZnDTP) to be used in the lubricant composition of the invention, such compound may be represented by the formula (1):

(1)

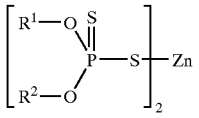

where $R^1$ and $R^2$ are independently the same or different primary, secondary alkyl groups of 3 to 20 carbon atoms. Information with respect to ZDTP may be found, for example, in U.S. Pat. No. 4,904,401. The ZDTP will constitute 0.1 to 0.75 wt % of the composition.

The composition of the invention may and preferably will include antioxidants such as phenolic and aminic type antioxidants well known in the art. Mixtures of these are especially suitable. Effective amounts of such additives are typically in the range of about 0.5 wt % to about 5.0 wt % based on the total weight of the composition.

The compositions of the invention may also include a VI improver, defoamant and seal swelling agent. Typical VI improvers include polymethacrylates, olefin polymers, copolymers and terpolymers (butene, ethylene-propylene, ethylene-butene, etc.), styrene-diene copolymers and the like. Typical defoamants include silicones and polyacrylates/methacrylates. Typical seal swelling agents include mono-esters, dibasic acid esters and polyol esters.

Among the features of the compositions of the invention is that they have low sulfur, phosphorous and ash. For instance the total sulfur content is less than 0.18 wt %, the phosphorous less than 0.048 wt % and the sulfated ash less than 0.5 wt %.

The compositions of the invention are particularly useful in conjunction with fuels having ultra-low sulfur content, i.e., a sulfur content below about 350 ppm.

The invention is further illustrated with reference to the following Examples.

EXAMPLES

Lubricating composition according to the invention were prepared using a blend of PAO and alkyl aromatic fluid.

In addition to a boron-containing ashless dispersant, metal detergent, molytrimer friction modifier, and ZDTP the composition included phenolic and aminic antioxidants, defoamant, seal swelling agent and VI improver.

Representative formulations are given in Table 1.

TABLE 1

| Formulation | 1 | 2 | 3 | 4 |
|---|---|---|---|---|
| Viscosity Grade | 0W-40 | 0W-20 | 0W-30 | 0W-40 |
| Component, wt % | | | | |
| Dispersant/Detergent | <12 | <10 | <10 | <8 |
| Total friction modifier | <0.9 | <0.5 | <0.5 | <0.5 |
| ZDTP antiwear additive | 0.2 | 0.2 | 0.2 | 0.2 |
| Tot. ashless antioxidant (Aminic/Phenolic) | <2.0 | <2.0 | <2.0 | <2.0 |
| Defoamant/VI improver/ Seal swelling agent | 2.56 | <1.8 | <1.8 | 2.68 |
| Base oil | balance | balance | balance | balance |

The sulfur, phosphorous, ash and TBN for the formulations is given in Table 2.

TABLE 2

| Formulation | 1 | 2 | 3 | 4 |
|---|---|---|---|---|
| Ash, wt % (ASTM D 874) | 0.38 | 0.38 | 0.38 | 0.38 |
| TBN | 3.44 | 3.54 | 3.5 | 3.54 |
| Phosphorous, ppm | 190 | 200 | 200 | 190 |
| Sulfur, ppm | 900 | 910 | 900 | 856 |

Performance evalution of the formulations is given in Table 3. For comparative purposes Table 3 also includes the performance evaluation for a commercially available normal sulfur, phosphorous and ash, OW-40, lubricating composition (Composition 1).

TABLE 3

| Formulation Test Method | Special Remark | Composition 1 | 1 | 2 | 3 | 4 |
|---|---|---|---|---|---|---|
| HFRR[1] | Average friction | 0.1252 | 0.0714 | 0.0562 | 0.0746 | 0.0768 |
| 0.7 Kg/60 Hz/0.5 mm | % average film | 0 | 53.25 | 81.42 | 88.42 | 42.91 |
| 60 minutes/75° C. | Scar X/Y (mm) | 0.3/0.7 | 0.28/0.67 | 0.3/0.67 | 0.27/0.67 | 0.283/0.683 |
| Set One | Calculation scar area ($mm^2$) | 0.165 | 0.148 | 0.157 | 0.14 | 0.152 |
| HFRR[1] | Average friction | 0.093 | 0.0413 | 0.0279 | 0.0335 | 0.0405 |
| 0.5 Kg/60 Hz/1.0 mm | % average film | 4.66 | 67.05 | 89.336 | 90.71 | 53.578 |
| 60 minutes/100° C. | Scar X/Y (mm) | 0.3/1.28 | 0.23/1.17 | 0.2/1.133 | 0.217/1.17 | 0.25/0.167 |
| Set Two | Calculation scar area ($mm^2$) | 0.302 | 0.214 | 0.178 | 0.199 | 0.229 |

TABLE 3-continued

| Formulation Test Method | Special Remark | Composition 1 | 1 | 2 | 3 | 4 |
|---|---|---|---|---|---|---|
| Four-Ball Wear 20 Kg/1800 rpm/ 60 minutes/130° F. | WSD (mm) | 0.317 | 0.294 | 0.267 | 0.25 | 0.267 |
| | K Factor (×10E-8) | 0.09 | −0.02 | 0.08 | 0.03 | 0.08 |
| PDSC[2] | | | | | | |
| Ramping @ 10° C. min. | Onset temperature (° C.) | 236 | 253.1 | 249.1 | 247.3 | 259.6 |
| Isothermal @ 220° C. | Time (minutes) | 10.8 | 16.2 | 26.2 | 11.6 | 23.6 |
| Hot Tube Test | | | | | | |
| 16 hours/288° C. | 1 = clean, 9 = dirty | 3 | 3 | 3 | 2.3 | 2 |
| Ash (D874) | Wt % | 0.96 | 0.38 | 0.38 | 0.38 | 0.41 |
| Base Number (D2896) | | 8.46 | 3.44 | 3.54 | 3.5 | 3.54 |
| Elements (M5185) | | | | | | |
| Zinc | Ppm | 1000 | 210 | 220 | 200 | 210 |
| Molybdenum | Ppm | 0 | 190 | 190 | 190 | 200 |
| Boron | Ppm | 180 | 210 | <50 | 100 | 240 |
| Phosphorous | Ppm | 960 | 190 | 200 | 200 | 190 |
| Sulfur (D262201) | Ppm | 3080 | 900 | 910 | 900 | 856 |
| Sequence IVA | | | | | | |
| Cam nose wear (micron) | | 56.9 | 25.3 | 40.9 | 11.1 | 6.1 |
| Total wear (micron) | | 305 | 129 | 194 | 57 | 32.2 |

[1]High frequency reciprocating rig
[2]Pressure differential scanning calorimetry As can be seen, the formulations of the invention have better performance characteristics than Composition 1. Specifically, as shown in Pressure Differential Scanning Calorimetry (PDSC), the onset temperature of oils 2 to 5 is 11 to 24 degrees higher than the results of oil 1 (ramping method). Since oxidation rates generally double with about every 10° C. increase in temperature, these results are impressive in terms of the ability of these oils to reduce and control oxidation. With the isothermal PDSC method, the oxidation resistance time is 1 to 15 minutes longer (9% to 143% better) than the result of oil 1.

The High Frequency Reciprocating Rig (HFRR) test results indicate that oils 2–5 can lower the average friction by 39–55% in condition set one and 62–75% in condition set two as reported in Table 1. Similarly, oils 2–5 can also increase film formation via electric contact potential (ECP) measurements from 43% to 88% (vs. 0% of oil 1) in condition set one and from 54% to 91% (vs. 5% of oil 1) in condition set two. Furthermore, the calculated scar area (from X-axis and Y-axis) of oil 1 is much larger than the scar area of oils 2–5 (5–18% larger in condition set one, and 32–70% larger in condition set two). These results show that the low ash/S/P oils are surprisingly better than normal ash/S/P oil 1. Clearly (a) reducing friction by up to 75%, (b) increasing film formation up to 91%, and (c) reducing wear up to 70% is truly outstanding.

The hot tube test is used to assess cleanliness features of engine oils under high temperature oxidation conditions. As exhibited, oils 2–5 all have comparable or better cleanliness results than oil 1 (the lower the rating, the better the cleanliness).

Sequence IVA testing is a very critical engine test that is used to assess anti-wear performance of engine oils. As demonstrated the low ash/S/P oils (2–5) all exhibited better Sequence IVA performance than oil 1, the normal ash/S/P oil.

All U.S. patents cited herein are hereby incorporated in their entirety by reference.

What is claimed is:

1. A lubricating composition comprising:

(a) a major amount of a base oil of lubricating viscosity and having a sulfur content below about 300 ppm based on the weight of base oil;

(b) about 0.5 wt % to about 10 wt % of a boron-containing ashless dispersant;

(c) about 0.05 wt % to about 1.50 wt % of a molybdenum containing friction reducing additive;

(d) about 0.05 wt % to about 5.0 wt % of at least one kind of metal-type detergent selected from the group consisting of sulfonates, phenates and salicylates; and (e) 0.10 wt % to 0.75 wt % of a zinc dithiophosphate.

2. The composition of claim 1 wherein the base oil is selected from the group consisting of Group II, III, IV and V basestocks.

3. The composition of claim 1 wherein the base oil is a blend of synthetic base oils.

4. The composition of claim 3 wherein the boron-containing ashless dispersant is a polyisobutylene succinic ester-amide.

5. The composition of claim 4 wherein the molybdenum containing additive is selected from the group consisting of molybdenum diorganodithiocarbamates, molybdenum diorganodithiophosphates, trinuclear molybdenum compounds and mixture thereof.

6. The composition of claim 2 wherein the metal of the metal-type detergent is an alkaline earth metal.

7. In the method of combusting an ultra low sulfur fuel in an internal combustion engine lubricated with a lubricating composition, the improvement comprising using as the lubricating composition one comprising:

(a) a major amount of a base oil of lubricating viscosity and having a sulfur content below about 300 ppm based on the weight of base oil;

(b) about 0.5 wt % to about 10 wt % of a boron-containing ashless dispersant;

(c) about 0.05 wt % to about 5.0 wt % of a molybdenum containing friction reducing additive;

(d) about 0.05 wt % to about 5.0 wt % of at least one kind of metal-type detergent selected from the group consisting of sulfonates, phenates and salicylates; and (e) 0.10 wt % to 0.75 wt % of a zinc dialkyl dithiophosphate.

8. The method of claim 6 wherein the base oil is a Group IV or V basestock; the boron-containing dispersant is a polyisobutylene succinic ester-amide; the molybdenum additive is a trinuclear molybdenum compound; and the metal of the detergent is an alkaline earth metal.

9. A lubricating oil composition comprising:

(a) a major amount of an oil of lubricating viscosity and having a sulfur content below about 300 ppm sulfur;

(b) about 0.5 wt % to about 10 wt % of a boron-containing polyisobutylene succinic ester-amide ashless dispersant;

(c) about 0.05 wt % to about 1.50 wt % of a trinuclear molybdenum compound having the formula $Mo_3S_7(dtc)_4$, $Mo_3S_4(dtc)_4$ and mixture thereof where dtc represents diorganodithiocarbamate ligands;

(d) about 0.05 wt % to about 5.0 wt % of at least one metal-type detergent selected from the group consisting of calcium, magnesium and barium sulfonates, phenates and salicylates; and (e) 0.10 wt % to 0.75 wt % of a zinc dithiophosphate wherein the alkyl groups are the same or different alkyl groups of from 3 to 20 carbon atoms, said composition having a sulfur content of less than 0.18 wt %, a phosphorous content of less than 0.048 wt % and a sulfated ash of less than 0.5 wt %.

10. The composition of claim 9 including an effective amount of at least one lubricating additive selected from the group consisting of antioxidants, VI improvers, defoamants, and seal swelling agents.

11. A method for reducing friction and the wear in an oil lubricated engine combusting an ultra low sulfur fuel, the method comprising lubricating the engine under conditions of use with a lubricating composition comprising:

a major amount of an oil of lubricating viscosity having a sulfur content below about 300 ppm sulfur;

about 0.5 wt % to about 10 wt % of a boron-containing ashless dispersant;

about 0.05 wt % to about 1.5 wt % of a molybdenum containing friction reducing additive;

about 0.05 wt % to about 5.0 wt % of at least one kind of metal-type detergent selected from the group consisting of sulfonates, phenates and salicylates; and 0.10 wt % to 0.75 wt % of a zinc dithiophosphate.

12. The method of claim 11 wherein the composition has a total sulfur content of less than 0.18 wt %, a phosphorous content of less than 0.048 wt % and a sulfated ash of less than 0.5 wt %.

13. The method of claim 12 wherein the composition has a total base number less than 4.

14. The method of claim 13 wherein the molybdenum containing friction reducing compound is a trinuclear molybdenum compound having the formula $Mo_3S_7(dtc)_4$, $Mo_3S_4(dtc)_4$ and mixtures thereof where dtc represents diorganodithiocarbamate ligands.

* * * * *